US007740332B2

(12) United States Patent
Bassi

(10) Patent No.: US 7,740,332 B2
(45) Date of Patent: Jun. 22, 2010

(54) DEVICE FOR FAST DISPLACEMENT OF THE POSITION IN HEIGHT OF AN INTERNAL SHELF RESTING SURFACE OF AN ELECTRICAL HOUSEHOLD APPLIANCE, SUCH AS A REFRIGERATOR OR FREEZER

(75) Inventor: Alberto Bassi, Turin (IT)

(73) Assignee: ITW Industrial Components S.R.L., Milan (IT)

( * ) Notice: Subject to any disclaimer, the term of this patent is extended or adjusted under 35 U.S.C. 154(b) by 288 days.

(21) Appl. No.: 11/057,239

(22) Filed: Feb. 15, 2005

(65) Prior Publication Data

US 2005/0179351 A1 Aug. 18, 2005

(30) Foreign Application Priority Data

Feb. 17, 2004 (IT) ..... 2004A0087

(51) Int. Cl.
*A47B 96/04* (2006.01)

(52) U.S. Cl. ..... 312/408; 108/107

(58) Field of Classification Search ..... 312/404, 312/408, 351, 330.1, 323, 208.1; 108/106, 108/107, 108; 248/244, 241, 235; 211/90.02, 211/134, 187, 153; 292/332, 333, DIG. 4
See application file for complete search history.

(56) References Cited

U.S. PATENT DOCUMENTS 2,229,320 A * 1/1941 Balzano et al. ..... 108/75
2,276,942 A * 3/1942 Dibble ..... 108/143
3,516,369 A * 6/1970 Bidak et al. ..... 108/138
5,037,163 A * 8/1991 Hatcher ..... 312/323
5,483,902 A * 1/1996 Grosch ..... 108/143
5,642,924 A * 7/1997 Wohlrab et al. ..... 312/408
5,657,969 A * 8/1997 Bivens ..... 267/64.12

(Continued)

FOREIGN PATENT DOCUMENTS

WO WO 03/095912 11/2003

OTHER PUBLICATIONS

Patent Abstracts of Japan, Publication No. 07-091821, Apr. 7, 1995.

(Continued)

*Primary Examiner*—Janet M Wilkens
*Assistant Examiner*—Matthew W Ing
(74) *Attorney, Agent, or Firm*—Lowe Hauptman Ham & Berner LLP

(57) ABSTRACT

A device for fast displacement of the position in height of a shelf within a refrigerating cell of an electrical household appliance, such as a refrigerator or freezer, includes elements for the coupling with respective guides for supporting the refrigerating cell arranged in a plurality of positions fixed in height within the refrigerating cell itself and adjustment elements set between the coupling elements and respective opposite lateral sides of the shelf for selective displacement of the shelf between a first position and a second position, set at different heights, with respect to the coupling elements; in this way, the resting shelf can be coupled in use with a pair of guides set at a selected height in the refrigerating cell and can be displaced between two different heights with respect to that of the pair of guides simply by pushing the shelf itself upwards.

18 Claims, 3 Drawing Sheets

U.S. PATENT DOCUMENTS

| | | | | |
|---|---|---|---|---|
| 5,989,045 | A * | 11/1999 | Kimura | 439/159 |
| 6,164,218 | A * | 12/2000 | Donalson | 108/144.11 |
| 6,491,086 | B2 * | 12/2002 | Bettio et al. | 160/290.1 |
| 2003/0038571 | A1 * | 2/2003 | Obrock et al. | 312/408 |
| 2004/0119297 | A1 * | 6/2004 | Bella et al. | 292/300 |

OTHER PUBLICATIONS

Patent Abstracts of Japan, Publication No. 09-250870, Sep. 22, 1997.
Patent Abstracts of Japan, Publication No. 2001-091151, Apr. 6, 2001.

* cited by examiner

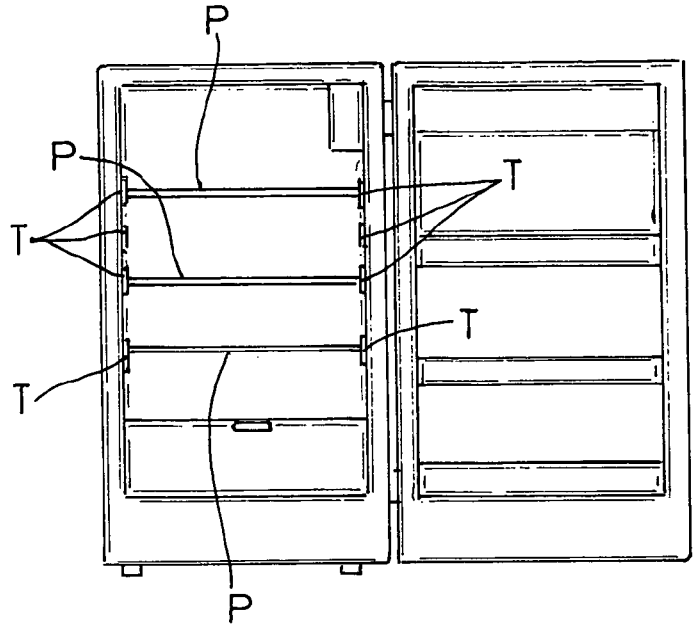
Fig.1 - prior-art -
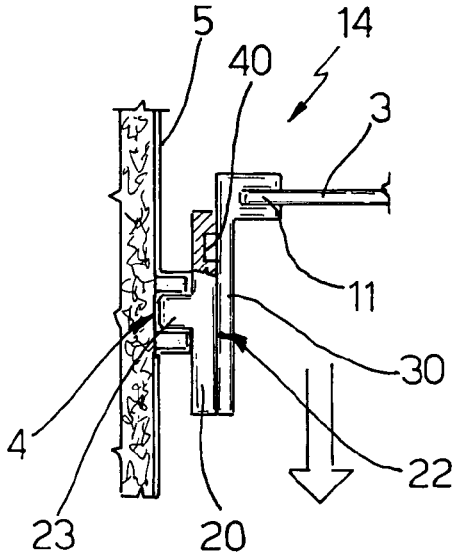
Fig.7
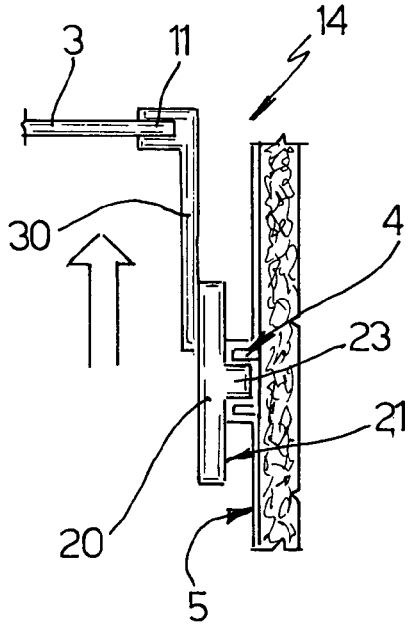
Fig.6

DEVICE FOR FAST DISPLACEMENT OF THE POSITION IN HEIGHT OF AN INTERNAL SHELF RESTING SURFACE OF AN ELECTRICAL HOUSEHOLD APPLIANCE, SUCH AS A REFRIGERATOR OR FREEZER

RELATED APPLICATIONS

The present application is based on, and claims priority from, Italian Application Number TO2004A000087, filed Feb. 17, 2004, the disclosure of which is hereby incorporated by reference herein in its entirety.

FIELD OF THE INVENTION

The present invention relates to a device for fast displacement of the position in height of an internal shelf resting surface of an electrical household appliance, such as a refrigerator or freezer.

BACKGROUND OF THE INVENTION

It is known that, in electrical household appliances provided with a refrigerating cell, such as refrigerators and freezers, the food to be conserved is usually arranged on a plurality of shelf resting surfaces arranged at different heights within the refrigerating cell. In order to adjust the position in height of said shelf resting surfaces, the refrigerating cell (FIG. 1) is equipped, on the opposite lateral sides, with a plurality of supporting guides T for the shelves P, usually present in a number greater than the number of shelves P available. In this way, the user can arrange the shelves P selectively at different heights, according to the volume occupied by the food to be conserved.

However, it occurs quite frequently that, when the user wishes to position a new article of food in the refrigerating cell, the free space that has remained available on the various shelf resting surfaces present does not enable their positioning.

In fact, it may happen that, where the article of food could find space on a certain shelf resting surface, this shelf resting surface will be positioned at a height such as to bring about the interference of another shelf set immediately above with the encumbrance in height of the article of food itself.

In this case, the user must proceed to a partial emptying of the refrigerating cell, so as to re-arrange the food in a suitable way and, frequently, must take out and reposition even one or more shelfs.

SUMMARY OF THE INVENTION

The purpose of the present invention is to overcome the drawbacks described above by providing a device for the displacement of the position in height of an internal shelf resting surface of an electrical household appliance, such as a refrigerator or freezer, which will be actuatable in a fast and simple way and without the need either to free the shelf resting surface of the food resting thereon, or to take out and re-insert the shelf in another position of the refrigerating cell.

It is moreover a purpose of the invention to provide a device of the aforesaid type that will be reliable, of reduced encumbrance, of low cost of production and easy to install, also on already existing electrical household appliances.

The present invention therefore relates to a device for fast displacement of the position in height of an internal shelf resting surface of a electrical household appliance, such as a refrigerator or freezer, as defined in claim 1.

In particular, according to the invention, the device for fast displacement comprises: means for the coupling with respective supporting guides of the refrigerating cell arranged in a plurality of positions fixed in height within said refrigerating cell; and adjustment means set between said coupling means and respective opposite lateral sides of the shelf for selectively displacing the shelf resting surface with respect to the coupling means between at least one first position and one second position, set at different heights. The adjustment means comprise, according to the invention: connection means of the pin-groove type having at least two blocking positions, arranged at different heights, and including at least one longitudinal groove extending parallel to said lateral sides of the shelf resting surface for a pre-set length and set parallel to the shelf resting surface itself, within which there is slidably engaged a pin that projects in cantilever fashion out of said groove; and a desmodromic path shaped like a Y set upside down, which is slidably engaged by said pin.

In this way, the shelf resting surface can be coupled in use with any pair of guides set at a selected height in the refrigerating cell and, subsequently, displaced between two different heights with respect to that of the pair of guides simply by pushing the shelf upwards and, hence, operating in a simple and fast way, and without the need either to take the shelf out of the refrigerating cell or to displace the food already positioned on the shelf resting surface itself.

BRIEF DESCRIPTION OF THE DRAWINGS

Further characteristics and advantages of the present invention will appear clearly from the ensuing description of its non-limiting examples of embodiment, made with reference to the annexed plate of drawings, in which:

FIG. 1 is a schematic illustration of a refrigerator provided with shelfs having resting surfaces, that are adjustable in height of a traditional type;

FIGS. 6 and 7 are cross-sectional views of the same details as those illustrated in FIGS. 4 and 5.

DETAILED DESCRIPTION OF THE INVENTION

With reference to FIGS. 2 to 7, designated as a whole by 1 is an electrical household appliance provided with a refrigerating cell 2, for example a refrigerator or freezer, of a type substantially known and provided with at least one shelf 3 having an upper resting surface for food (not illustrated), which can be inserted selectively in the refrigerating cell 2 on respective supporting guides 4 positioned, in facing pairs, in a plurality of positions fixed in height different from one another, within the refrigerating cell 2, along opposite side walls 5 of the refrigerating cell 2, according to an arrangement which is on the other hand well known.

According to the invention, the resting shelf 3 does not engage the guides 4 directly, as in the known electrical household appliance, but is instead provided with a device for fast displacement of the position in height of the resting shelf 3 within the refrigerating cell 2, designated as a whole by 10.

Figure 2:
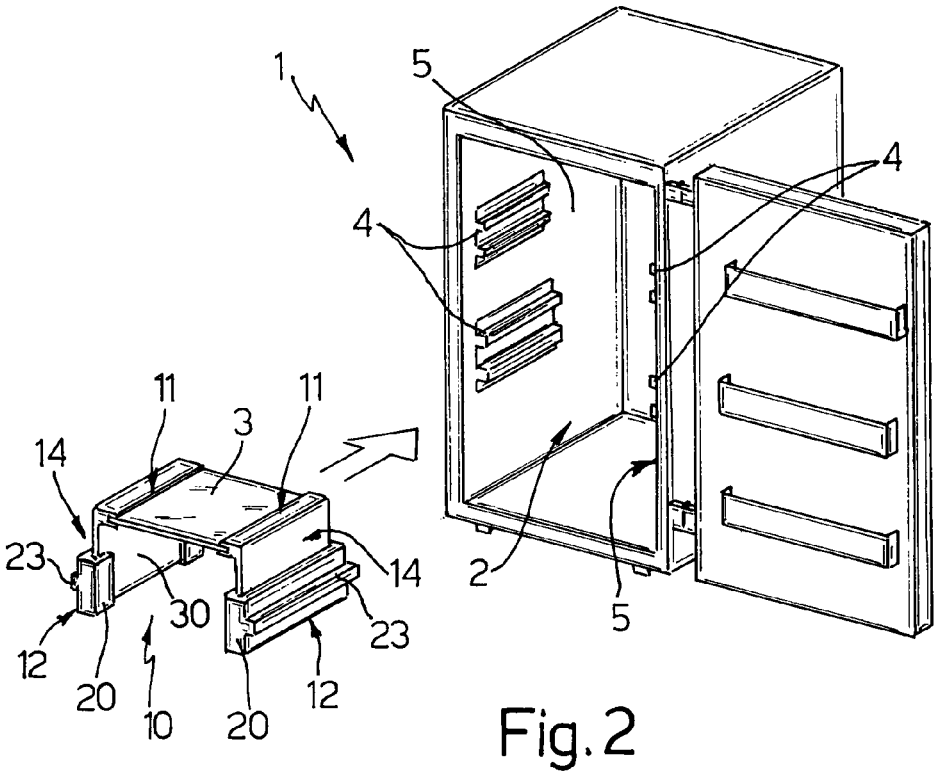
FIG. 2 is a schematic perspective three-quarter front view of a refrigerator provided with at least one shelf, illustrated in exploded view, provided with a device for fast displacement of the position in height of the shelf resting surface within the refrigerator, built according to the invention.
Figure 3:
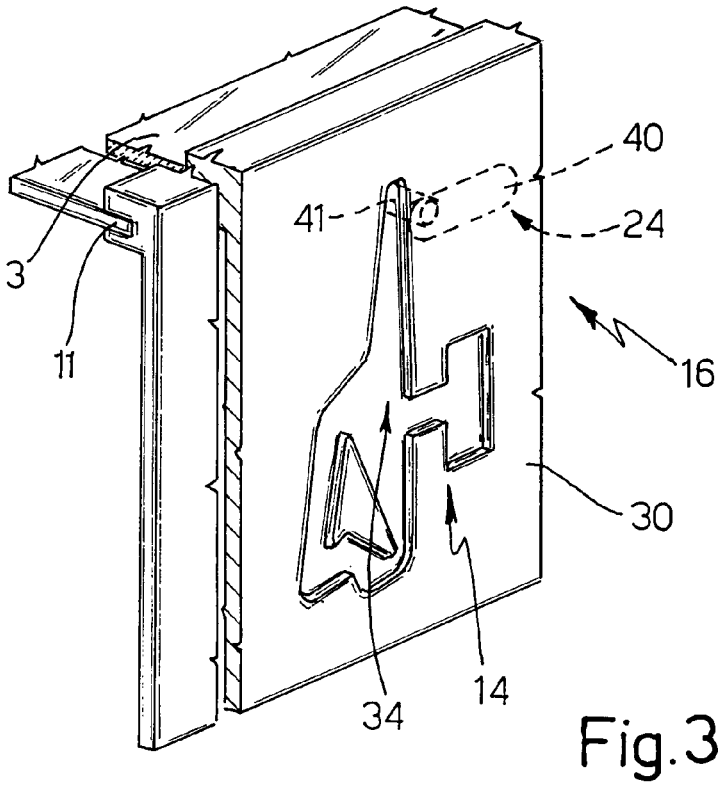
FIG. 3 is a perspective view, at an enlarged scale, of a portion of the shelf illustrated in FIG. 2 provided with the device according to the invention, with parts removed for reasons of simplicity.
Figure 4:
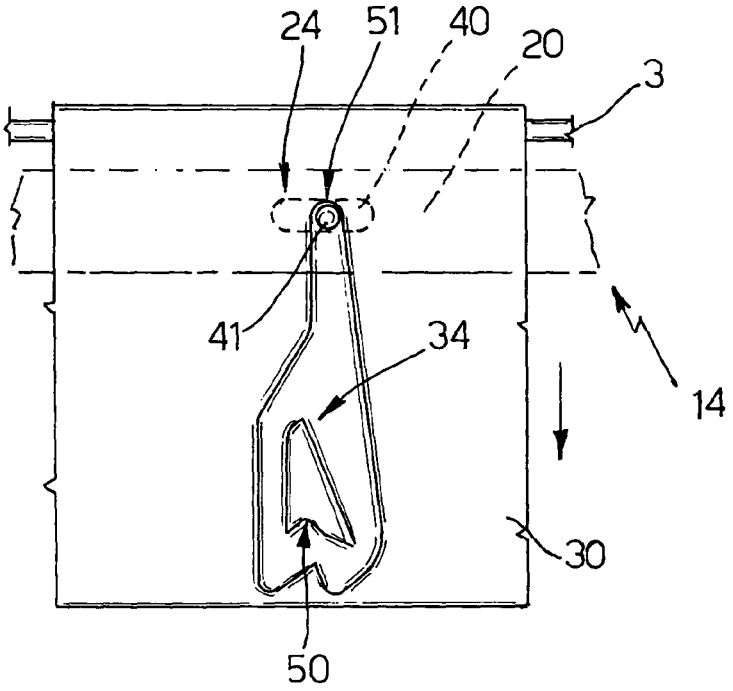
FIGS. 4 and 5 are elevations of the shelf and of the corresponding device illustrated in FIG. 2 in two different positions of operation.
Figure 5:
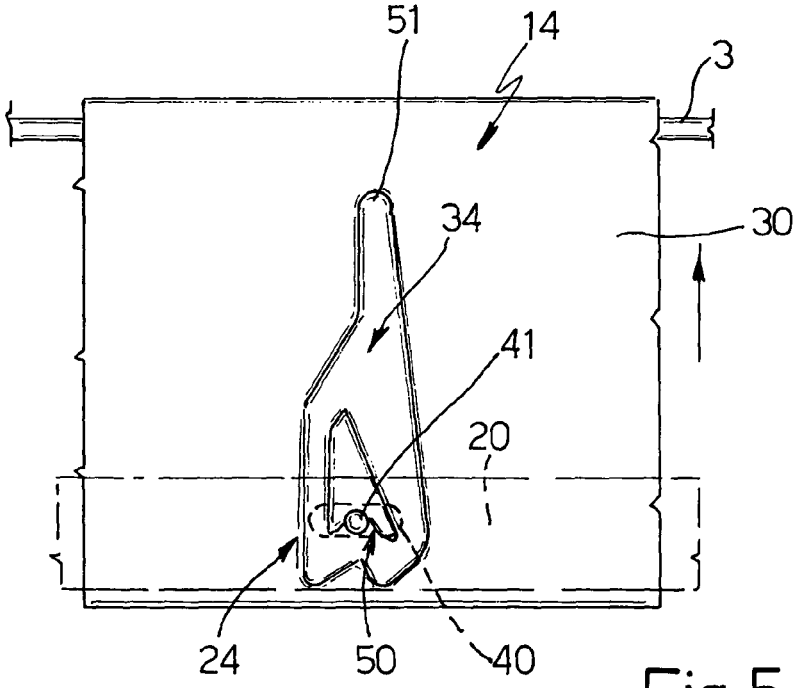

The device 10 (FIG. 2) according to the invention comprises, on both of the opposite lateral sides 11 of the rsting 3, means 12 for coupling with the guides 4, and adjustment means 14, set between the coupling means 12 and the lateral sides 11 of the shelf 3, for selectively displacing the shelf 3 and resting surface itself with respect to the coupling means 12 between at least one first position, illustrated in FIGS. 4 and 7, and one second position, illustrated in FIGS. 5 and 6, set at different heights.

The adjustment means 14 are of the type in which the resting shelf 3, when it is coupled in use with a pair of guides 4 set at a selected height in the refrigerating cell 2, can be displaced between at least two different heights, with respect to that of the pair of guides 4 selected, by means of a simple thrust from beneath upwards exerted by a user on the resting shelf 3 itself, typically underneath the latter, so as not to interfere with the food possibly arranged on the resting shelf 3.

The adjustment means 14 are of the type comprising connection means 16 of the pin-groove type having at least two blocking positions, arranged in use at different heights in the refrigerating cell 2 and corresponding to said first and second positions of the shelf 3 with respect to the coupling means 12.

The connection means 16 of the pin-groove type, having at least two blocking positions, selected according to the invention have, as will be seen, a structure such that they do not require elastic means for their own operation, consequently ensuring considerable simplicity of construction and assembly, high reliability, contained production costs and, above all, reduced overall dimensions.

According to the non-limiting example of embodiment illustrated herein, the coupling means 12 comprise at least one pair of opposite first supports constituted by longitudinal members each delimited, on the opposite sides, by a first face 21 and a second face 22 (FIGS. 6 and 7). The first face 21, facing in use a respective side wall 5 of the refrigerating cell 2, is provided with a mated element 23 of slidable coupling with a respective supporting guide 4, in the example illustrated herein constituted by a projecting prismatic element. The second face 22, facing in use the resting shelf 3, is provided with first hooking elements 24 (illustrated dashed in FIG. 3, in so far as they are present on a part of the device 12 which is removed for reasons of simplicity) forming part of the connection means 16 of the pin-groove type according to the invention.

The adjustment means 14 according to the invention moreover comprise at least one pair of second supports, constituted by plane plates 30, each associated to a respective lateral side 11 of the shelf 3. The plates 30 carry second hooking elements 34 of the pin-groove connection means 16, complementary to the first hooking elements 24.

The longitudinal members 20 are arranged parallel to the supporting guides 4 and to the plane of lie of the resting shelf 3, whilst the plane plates 30 are arranged perpendicular to the shelf 3 and project in cantilever fashion downwards with respect to the plane of lie of the resting shelf 3, to which they are fixedly connected, possibly in a removable way. It is, however, obvious that also the arrangement dual with respect to the one described is possible, with the longitudinal members 20 connected to the shelf 3 and the plates 30 provided with the elements 23 instead of with the longitudinal members 20 and fixed in use to the guides 4 of the side walls 5 of the refrigerating cell 2.

The first hooking means 24 are constituted, for each plate 30 present, by a longitudinal groove 40 extending parallel to the lateral sides 11 of the shelf 3 for a pre-set length and set parallel to the shelf resting surface, made of a single piece in a respective longitudinal member 20 (FIG. 7), within which there is slidably engaged a pin 41, which projects in cantilever fashion out of the groove 40 and towards a corresponding plate 30.

The second hooking means are constituted by a desmodromic path 34 (FIGS. 3, 4, 5), of the type known normally used in opening devices of a "push-push" type, for example on the door of the glove-box of the dashboard of a vehicle, in general coupled to a restraining device and a spring for opening the door.

The desmodromic path 34 is made on a face of each plates 30 facing in use the side opposite to the shelf 3 and shaped like a Y set upside down, and is slidably engaged by the pin 41.

Consequently, following upon an upward thrust exerted by the user on the resting shelf 3 (FIGS. 5 and 6), the pin 41, which is free to move in the groove 40, which has a length suitable for the purpose, can slide along the two branches of the Y-shaped path 34 to reach the two different positions of engagement defined thereby, designated by 50 and 51 in FIGS. 4 and 5, in a position corresponding to which the path 34 has appropriate bends into which the pin 41 "snaps", remaining blocked and supporting in the position reached the resting shelf 3 on the guides 4, through the respective longitudinal member 20, to which the pin 41 connects the plate 30 in a vertically mobile way between the two different vertical positions described. A new movement of upward thrust of the shelf 3 produces disengagement of the pin 41, as a result of the appropriate shaping of the path 34, enabling it to reach the other position and be blocked therein.

The invention claimed is:

1. A device for positioning a shelf at different heights within a cell of an appliance having shelf supporting guides arranged at predetermined distances from a bottom of the cell, said device comprising:

a coupling element having opposite a first side and a second side, said first side being adapted to engage with the respective supporting guide;

an adjusting element coupled to the second side of said coupling element while being moveable vertically with respect to the coupling element, said adjusting element being adapted to receive a respective one of lateral sides of the shelf; and at least a pin which is slidably mounted inside an elongated slot located on the second side of the coupling element and extends outward from said slot;

wherein said adjusting element has a closed retaining groove having a plurality of blocking structures corresponding to a plurality of relative vertical positions between the adjusting element and the coupling element; and said pin extends from the slot into said retaining groove and is moveable, in a predefined path inside the retaining groove until said pin is retained by one of the blocking structures, thereby displacing the adjusting element among said relative vertical positions of the adjusting element and the coupling element and thereby facilitating vertical movement of the shelf to a plurality of heights within the cell without having to move the coupling element to the other supporting guides, wherein, when said pin is retained by any one of the blocking structures, said pin is only dislodgeable from said blocking structure by an upward force exerted by a user on the adjusting element.

2. The device according to claim 1, wherein said first side of said coupling element includes a horizontally elongated projection.

3. The device according to claim 1, wherein the slot is elongated horizontally.

4. The device according to claim 1, wherein said adjusting element has opposite third and fourth sides, the third side facing and being adjacent the second side of said coupling element, the fourth side being adapted to face, in use, the shelf; and the retaining groove is on the third side of the adjusting element, has a shape of a Y, and is slidably engaged by said pin.

5. The device according to claim 1, wherein said adjusting element coupled to the second side of said coupling element is immoveable horizontally relative to said coupling element.

6. The device according to claim 1, wherein said coupling element includes two holding portions each holding one of opposite ends of the adjusting element, respectively, the opposite ends of the adjusting element are vertically slidable within said holding portions, respectively, and the adjusting element is restricted, by the holding portions, from moving horizontally relative to the coupling element.

7. An appliance, comprising:

a cell having supporting guides, on side walls of the cell, arranged at predetermined distances from a bottom of the cell;

at least one shelf; and at least a device for positioning said shelf at different heights within said cell of said appliance, said device comprising:

a coupling element having opposite a first side and a second side, said first side slidably engaged with one of the supporting guides in the cell;

an adjusting element coupled to the second side of said coupling element while being moveable vertically with respect to the coupling element, said adjusting element holding a respective one of lateral sides of the shelf; and at least a pin which is slidably mounted inside an elongated slot located on the second side of the coupling element and extends outward from said slot;

wherein said adjusting element has a closed retaining groove having a plurality of blocking structures corresponding to two fixed vertical positions between the adjusting element and the coupling element; and said pin extends from the slot into said retaining groove and is moveable, in a predefined path inside the retaining groove until said pin is retained by one of the blocking structures, thereby displacing the adjusting element among the two fixed vertical positions of the adjusting element and the coupling element and thereby facilitating vertical movement of the shelf to a plurality of heights within the cell without having to move the coupling element to the other supporting guides, wherein, when said pin is retained by any one of the blocking structures, said pin is only dislodgeable from said blocking structure by an upward force exerted by a user on the shelf.

8. The appliance according to claim 7, wherein said first side of said coupling element includes a horizontally elongated projection.

9. The appliance according to claim 7, wherein the slot is elongated horizontally.

10. The appliance according to claim 7, wherein said adjusting element has opposite third and fourth sides, the third side facing and being adjacent the second side of said coupling element, the fourth side facing the shelf; and the retaining groove is on the third side of the adjusting element, has a shape of a Y, and is slidably engaged by said pin.

11. The appliance according to claim 7, wherein said adjusting element coupled to the second side of said coupling element is immoveable horizontally relative to said coupling element.

12. The appliance according to claim 7, wherein said coupling element includes two holding portions each holding one of opposite ends of the adjusting element, respectively, the opposite ends of the adjusting element are vertically slidable within said holding portions, respectively, and the adjusting element is restricted, by the holding portions, from moving horizontally relative to the coupling element.

13. The appliance according to claim 7, wherein said adjusting element has two parallel projections defining a fork slidably retaining the respective lateral side of the shelf.

14. The device according to claim 1, wherein said adjusting element has two parallel projections defining a fork slidably retaining the respective lateral side of the shelf.

15. The device according to claim 1, wherein said pin is always contained within the closed retaining groove.

16. The device according to claim 1, wherein said adjusting element further comprises a T-shaped slot joined with the closed retaining groove.

17. The appliance according to claim 7, wherein said adjusting element further comprises a T-shaped slot joined with the retaining groove at a position between the fixed vertical positions.

18. The appliance according to claim 7, wherein said appliance is a refrigerator.

* * * * *